US005561989A

United States Patent [19]

Mista

[11] Patent Number: 5,561,989

[45] Date of Patent: Oct. 8, 1996

[54] JACQUARD BAR FOR WARP KNITTING MACHINES

[75] Inventor: Kresimir Mista, Heusenstamm, Germany

[73] Assignee: Karl Mayer Textilmachinenfabrik GmbH, Obertshausen, Germany

[21] Appl. No.: 490,957

[22] Filed: Jun. 15, 1995

[30] Foreign Application Priority Data

Jun. 18, 1994 [DE] Germany ..... 44 21 389.1

[51] Int. Cl.[6] ..... D04B 27/32

[52] U.S. Cl. ..... 66/205; 66/207

[58] Field of Search ..... 66/203, 204, 205, 66/207, 208, 214

[56] References Cited

U.S. PATENT DOCUMENTS

| | | | |
|---|---|---|---|
| 2,418,445 | 4/1947 | Amidon | 66/214 |
| 4,570,462 | 2/1986 | Roth | 66/205 X |
| 5,390,512 | 2/1995 | Mista | 66/205 |

FOREIGN PATENT DOCUMENTS

| | | | |
|---|---|---|---|
| 4019111 | 6/1990 | Germany . | |
| 4017357 | 10/1991 | Germany | 66/207 |
| 4019111 | 12/1991 | Germany | 66/207 |
| 4226899 | 1/1994 | Germany . | |
| 3092762 | 4/1988 | Japan | 66/207 |
| 896545 | 5/1962 | United Kingdom . | |

*Primary Examiner*—John J. Calvert
*Attorney, Agent, or Firm*—Omri M. Behr Esq.

[57] ABSTRACT

A Jacquard bar (1) for warp knitting machines having at least one row of guides (4), which can be moved to and fro between two stops (6). A thread redirecting edging (11) covers the intermediate spaces between the stops (6). The redirecting edging (11) is fixed positionally by connection with the stops (6). In this way the weight of the components bearing the redirecting edging can be reduced allowing precise positioning of the guides in operation.

24 Claims, 3 Drawing Sheets

Fig. 2
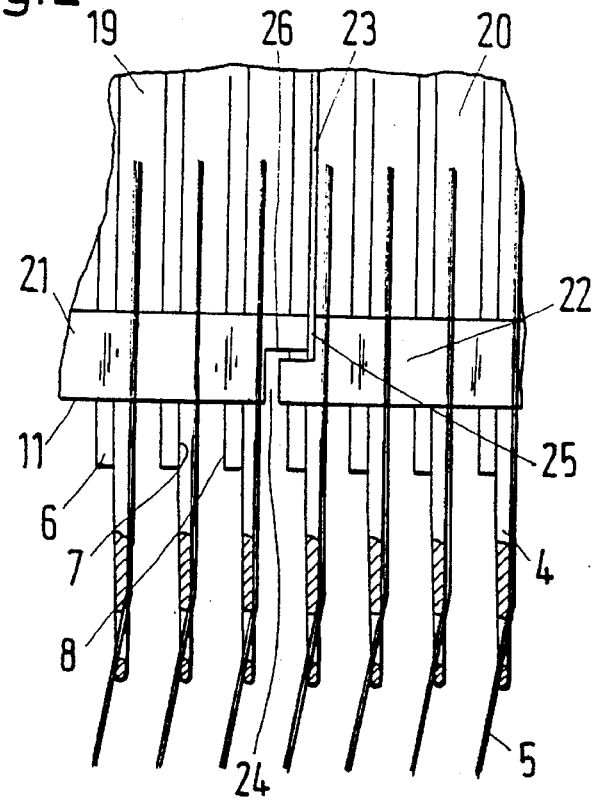
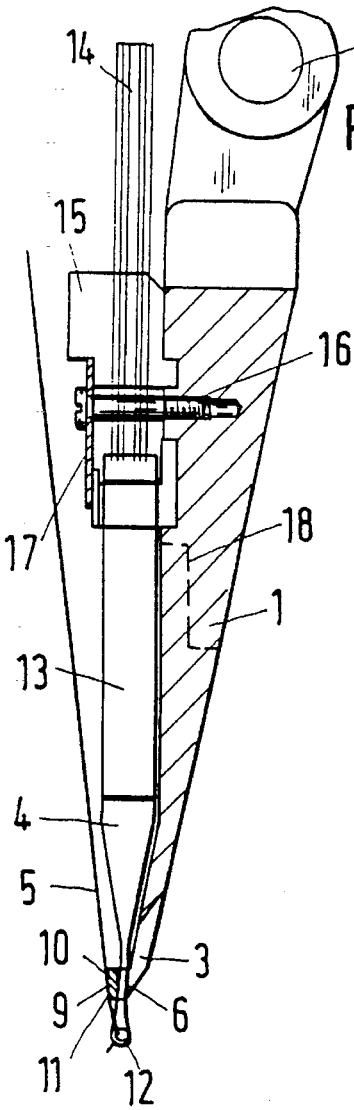
Fig. 1
Fig. 5
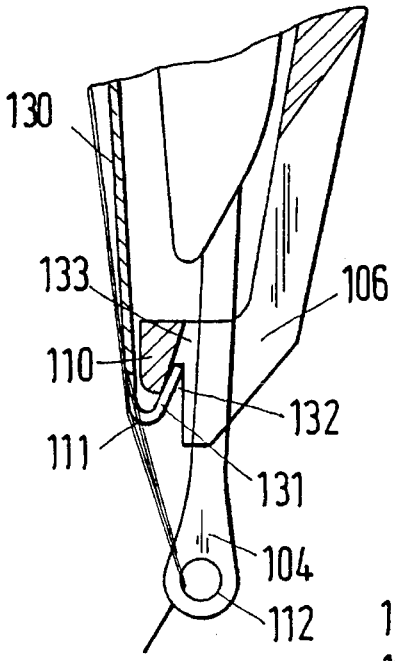
Fig. 6
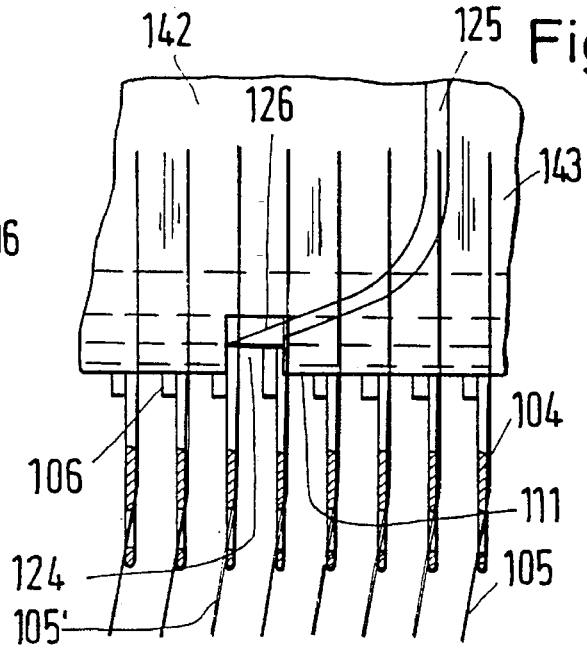

JACQUARD BAR FOR WARP KNITTING MACHINES

FIELD OF THE INVENTION

The present invention relates to a Jacquard bar for warp knitting machines with at least one row of guides, which are moved laterally reciprocated between two stops by means of a control device, and with a thread redirecting edging which covers the spaces between the stops.

DESCRIPTION OF RELATED ART

In the case of a known Jacquard bar of this type, (DE 40 19 111 C2) it is shown, but not described, that the spaces between the stops are covered by a flat cover plate. The upper longitudinal edge thereof is attached by means of screws to carriers connected to the bar. The lower edge ends slightly below the stops and forms the redirecting edging.

In practice this cover plate comprises sheet metal segments which are individually screwed to the bar. So that no open joints occur which could result in the thread becoming jammed, the sheet metal segments are assembled in a non-abutting, overlapping manner. Because of the double metal thickness at the overlapping points more space is required, and the weight also increases. Dismantling during maintenance work is made more difficult by the overlapping. In operation the sheet metal segments tend to open out. For this reason sheet metal of adequate thickness must be used and, if necessary, stiffening by means of beading, must be provided.

This problem does not only apply to Jacquard bars in which the guides are moved to and fro between the two stops by means of forcing elements and harness cords, but also Jacquard bars in which the needles are controlled in other ways, for example through being carried by piezoelectric bending converters, as is known from DE 42 26 899 C1.

Accordingly, an object of the present invention is to disclose a Jacquard bar of the initially described type in which the weight of the components carrying the redirecting edging is reduced and high positioning accuracy of the guides is achieved.

This task is solved in accordance with the present invention in that the redirecting edging is positionally fixed by connection to the stops.

SUMMARY OF THE INVENTION

In accordance with the illustrative embodiments demonstrating features and advantages of the present invention, there is provided a Jacquard bar for warp knitting machines including a spaced plurality of stops. Also includes is a plurality of guides arranged in at least one row to interdigitate with and reciprocate between the stops. The bar includes a control device for selectively positioning the guides between the stops. The bar also has a thread redirecting edging for covering interspaces between the stops and maintaining a positionally fixed relationship with the stops by connection with the stops.

In this design there is a precise coordination between the redirecting edging and the stops, which is not impaired by vibration of the cover plate. The redirecting edging does not therefore transmit vibrations to the threads, so that the product is not adversely affected and the position of the guides is not undesirably changed. It is of particular importance here that as a result the fixed allocation, the stops can be arranged near to the needle head, so that the guides have a high degree of positional accuracy in both their end positions.

In a very low weight embodiment the redirecting edging is formed on a longitudinal rib connecting the stops. As the longitudinal rib is kept at short distances from the stops a small rib cross section is sufficient. The additional weight required for redirecting can thus be kept very small. This applies particularly if the longitudinal rib and stops are made of light metal, such as aluminum.

In another preferred embodiment there is a cover plate, which has a curled longitudinal edge forming the redirecting edging, supported by the curled edge section on an extension of the stops. The cover plate provides in the area of the other longitudinal edge a fixed, but detachable, connection to the bar. The support ensures secure coordination between the redirecting edging and the stops. As the support is not on the stops but on an extension thereof, the movement of the needle is not hindered. The support on one longitudinal edge and attachment to the other longitudinal edge, hold the longitudinal edge securely to the bar. The curled longitudinal edge provides the cover plate with increased rigidity. The tendency to vibrate is very considerably reduced. It is possible to work with much thinner cover plates than before.

In both the above embodiments the redirecting edging can be rounded to protect the threads. In the case of the longitudinal rib this is through appropriate designing of the cross section, and in the case of the cover plate by bending of the edging.

In a further embodiment of the invention it is ensured that a group of stops is arranged on a holding segment attached to the bar and the flush longitudinal ribs of adjacent holding segments overlap in such a way that the flush joint close to the redirecting edging has a thread redirecting segment with one longitudinal component. This measure can be used if the longitudinal ribs themselves carry the redirecting edging.

In a preferred alternative the cover plate is formed of flush sheet metal segments which overlap in the vicinity of the first and/or second redirecting edging in such a way that the flush joint close to the redirecting edging has a thread redirecting segment with one longitudinal component.

In both said designs the majority of the threads are in contact with the redirecting edging. In the joint area on the other hand the thread does not have this contact point. It is redirected on the joint's redirecting segment, which has a longitudinal component for this purpose. As this section can be arranged close to the redirecting edging the latter thread can also be securely fed in.

In an advantageous embodiment the redirecting edging is in the longitudinal direction. Redirecting takes place in a similar manner to the redirecting edging. In many cases it is however better if the longitudinal, thread redirecting segment is at an angle of less than 45°. This results in greater stability in the overlapping area so that the redirecting segment can be arranged closer to the redirecting edging without loss of stability.

BRIEF DESCRIPTION OF THE DRAWINGS

The invention is described below in connection with the preferred embodiments and with reference to the following drawings:

FIG. 1 shows a cross sectional view through a Jacquard bar in accordance with the principles of the present invention, FIG. 2 shows a left side view of the lower section of a bar, which has been slightly altered vis-a-vis FIG. 1, FIG. 5 shows a cross section through the working area of the embodiment in FIGS. 3 and 4, FIG. 6 shows a left side view of the embodiment in FIG. 5.

DETAILED DESCRIPTION OF THE PREFERRED EMBODIMENTS

Figure 3:
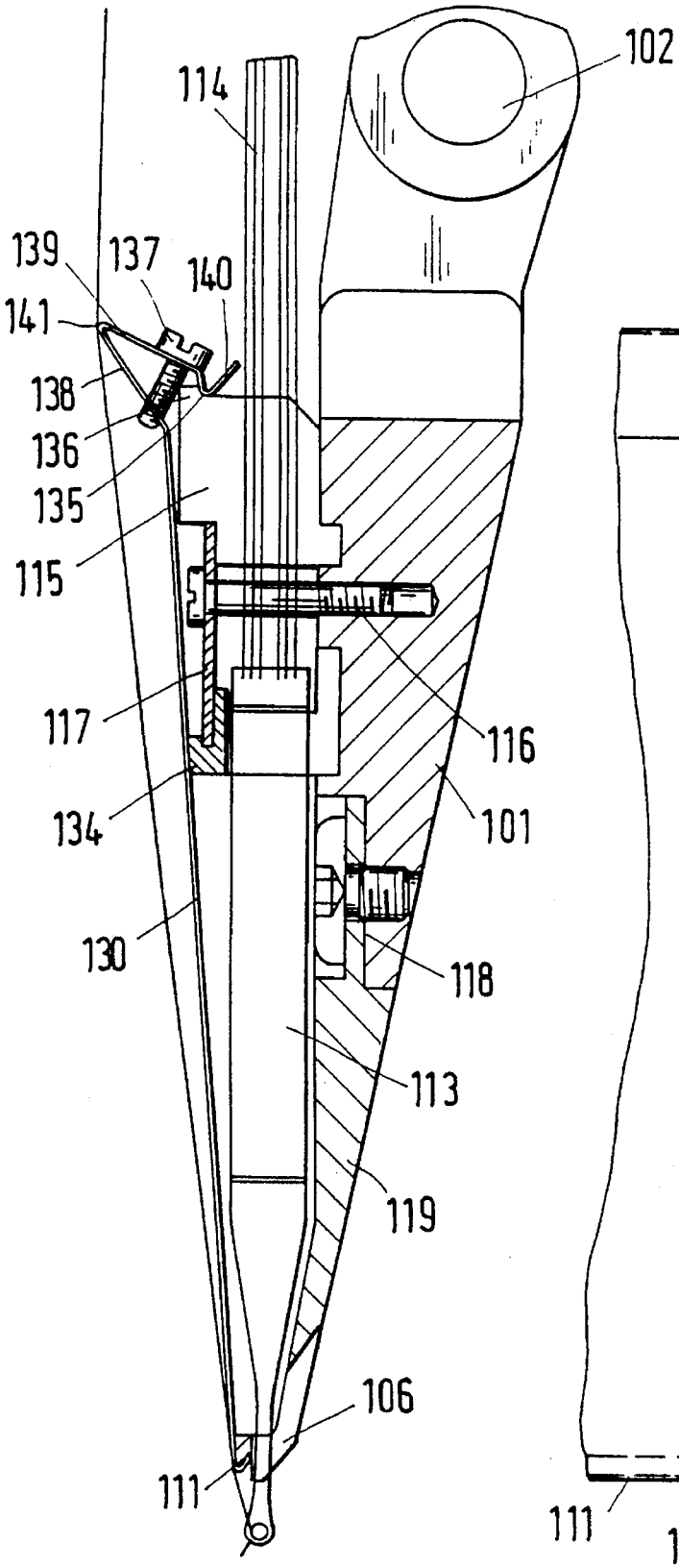
FIG. 3 shows a cross section through a modified embodiment of a Jacquard bar, also in accordance with the principles of the present invention.
Figure 4:
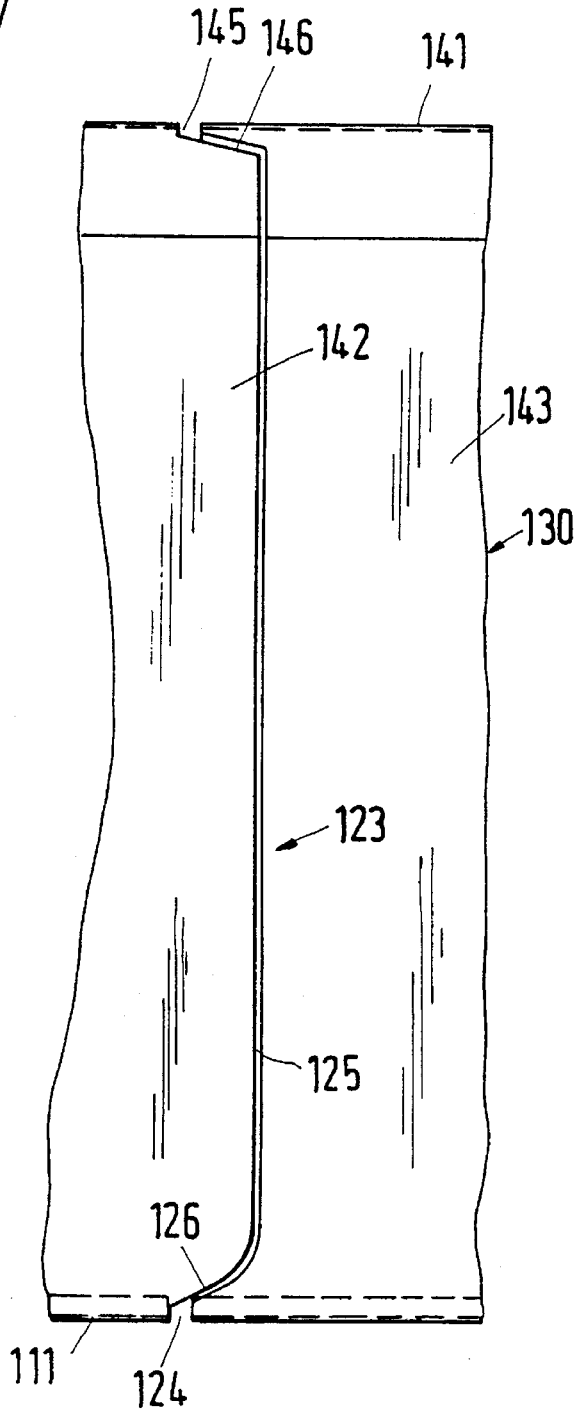
FIG. 4 shows the joint area between adjacent cover plates of FIG. 3.

In the embodiment according to FIG. 1 and the embodiment in FIG. 2, which is only slightly modified vis-a-vis FIG. 1, a guide bar 1 is arranged to pivot on an axis 2. The bar 1 has slits 3 at the bottom which each take up a guide 4 for guiding a thread 5. On both sides of each slit 3 there are stops 6. Depending on the control, each guide 4 can thus take up a first shown position, in which it rests on the left stop surface 7, or a second position in which it rests on the right stop surface 8.

These stops 6 have an extension 9 which forms a longitudinal rib 10 which closes the slits 3 on the thread feeder side, so that the threads 5 cannot intrude and obstruct the movement of the guide 4. Connecting extensions 9 to each other by a longitudinal rib 10, provides particularly great stability, even if the longitudinal rib has only a small cross section.

The longitudinal rib 10 also has a redirecting edging 11 over which the threads 5 are fed to the guide eye 12 of the guide 4. Preferably at least the redirecting edging 11 of rib 10 has an anti-wear coating. This applies particularly if the redirecting edging is on a component made of a light metal such as aluminium.

Each guide 4 is fixed to a piezoelectric bending converter, as known, for example, from DE 42 26 899 C1. By applying a potential difference to a piezoelectric active layer, the guide is moved into either a first or second position. To do this the appropriate voltage is supplied via a conductor cable 14. A group of bending transducers 13 with associated guides 4 is combined in a carrier segment 15 which is attached to the bar 1 by means of screws 16 and a clamping plate 17.

The bar 1 is shown in FIG. 1 as a uniform component continuous over its entire length. However, as shown by the broken line 18 in FIG. 1, a lower bar section can be provided separately from the upper bar section, where the upper section is continuous and the lower section is divided into individual holding segments, such as segments 19 and 20 as shown in FIG. 2. Each segment has a longitudinal rib 21, 22. Adjoining holding segments have a joint 23 between them, which is stepped in the area of the longitudinal ribs. This produces a broader, distal, joint section 24 and a narrower joint section 25, between which there is a thread redirecting segment 26 running in the longitudinal direction of the bar.

Preferably, the joint section 24 before the thread redirecting segment 26 has such a width in the longitudinal direction that it is still open to receive a thread even with adjoining holding or sheet metal segments. In this way it is ensured that the thread fed over the redirecting edging is not jammed when the segments are assembled adjacent to each other. The segments can thus be assembled with variously-sized joints, which is of interest, for example, if matching to the needle pitch of the knitting needle bar is to be undertaken.

Whereas the majority of the threads 5 are redirected on the redirecting edging 11, a thread 5 located in the vicinity of the joint can enter the joint section 24 and be redirected on redirecting segment 26. The width of the joint section 24 is dimensioned so that even with adjoining joint section 25 flanks the thread can reach the thread redirecting segment 26 unhindered. It should also be mentioned that the redirecting edging 11 has a coating which prevents premature wear of the aluminium longitudinal rib.

In the example of the embodiment according to FIGS. 3 to 6 reference figures increased by 100 are used for the appropriate components. In this design a cover plate 130 is used which through bending has a redirecting edging 111 on the lower longitudinal edge.

The curled edge section 131 engages recesses 132, which are provided in extensions 133 of the stops 106 arranged on the holding segments. It is particularly advantageous for the recesses 132 of extensions 133 to be shaped to receive an edge section of the cover plate bent by more than 90°. In this design the edge section is particularly securely determined. The extensions 133 are in turn connected to each other by longitudinal rib 110. As a result of the new design and attachment of the cover plate 130, the latter can be of small thickness. In most cases a thickness of 0.2 to 1.0 mm is sufficient.

A further feature of vibration reduction consists in the bar having a support element 134 on which the cover plate 130 rests at a point between both its longitudinal edges. Specifically, cover plate 130 is supported in the middle of its height by a support element 134. If the cover plate 130 is attached in such a way that under pretension it is in contact with the support element 134, a particularly solid design is achieved. This support element 134 can be an elastomeric strip, for example, which is firmly attached to the guide bar 101. The cover plate 130 can rest under pressure on the support element 124.

As an attachment measure it is advantageous that at the other longitudinal edge of the cover plate 130 a support extremity 135 for resting on a carrier 115 connected with the bar is arranged and the distance between the support extremity 135 and the redirecting edging 111 can be shortened by means of two pleated, contractable, sheet metal sections 138, 139, angled off in opposite direction to the sheet metal plane, which can be moved towards each other by means of screws 137.

The support extremity 135 at the upper end of the cover plate 130 acts as an attaching means and is supported on the carrier 115 connected with the bar by gripping on the carrier 115 behind a strip 136. With the aid of screws 137 the distance between the support extremity 135 and the redirecting edging 111 can be shortened so that the cover plate 130 can be held securely in place after insertion of the curled edge section 131 into the recesses 132 and swinging into the assembly position followed by tightening of the screws 137.

For this purpose the cover plate 130 is provided with a first sheet metal section 138 which is bent out of the sheet metal plane at one side, and a second sheet metal section 139 which is bent in the opposite direction. Both of these pleated, contractable, sheet metal sections 138 and 139 can be pulled towards each other by means of threaded elements or screws 137. An oblique surface 140 facilitates sliding on during assembly.

This shortening results in taut fixing of the cover plate 130 with a low vibration tendency. By operating the screws 137 in the opposite direction the distance between the support extremity 135 and the redirecting edging 111 can be increased so far that the cover can be removed as a whole including the screws 137 and replaced if necessary.

It is also recommended that the other longitudinal edge also has a bending point 141 to form a second redirecting edging. In this way it can be ensured that the thread only rests on the two redirecting edges, while friction on the remaining surface of the cover plate 130 is avoided.

Thus an opposite edging 141 for redirecting thread is formed on the bending point (bight 141) between the pleated, contractable, sheet metal sections 138 and 139. This redirecting edging 141 is located outside the cover plate 130 plane. The thread 105 is thus held at a certain distance from the cover plate so that it is not impaired by friction over longer stretches.

The cover plate 130 consists of individual sheet metal segments 142 and 143, between which there is a joint 123. Here there is a thread redirecting segment 126 between a broader, distal, joint section 124 and a narrower joint section 125, which in this case runs at an angle of 30° to 40° to the longitudinal direction of the bar. In this way the effective part of the redirecting segment 126 can be brought close to the redirecting edging 111 without causing stability problems with regard to the overlapping part 144 of the cover plate. There is also a joint section 145 at the upper longitudinal edge which is broader than the joint section 124 and an oblique, thread redirecting segment 146.

As shown in FIG. 6, most of the threads 105 are in contact with the redirecting edging 111. Only the thread 105' in the joint area runs in the joint section 124 and is redirected at the redirecting edging 126, which is adjacent to the redirecting edging 111.

The sheet metal segments can be of a length reaching over several holding segments. This produces further centering of the holding elements through the curled edge section 131 which penetrates into the recess 132. At the same time the cover plates serve as protective plates. They prevent premature contamination and, in conjunction with the bending transducers 113 serve as contact protection for the voltage-carrying components. The pretensioning of the sheet metal sections 138, 139 against each other ensures that the screws 137 are held securely in place. They are operated from above and can thus be reached much more easily than screws operated from the side.

Figure 7:
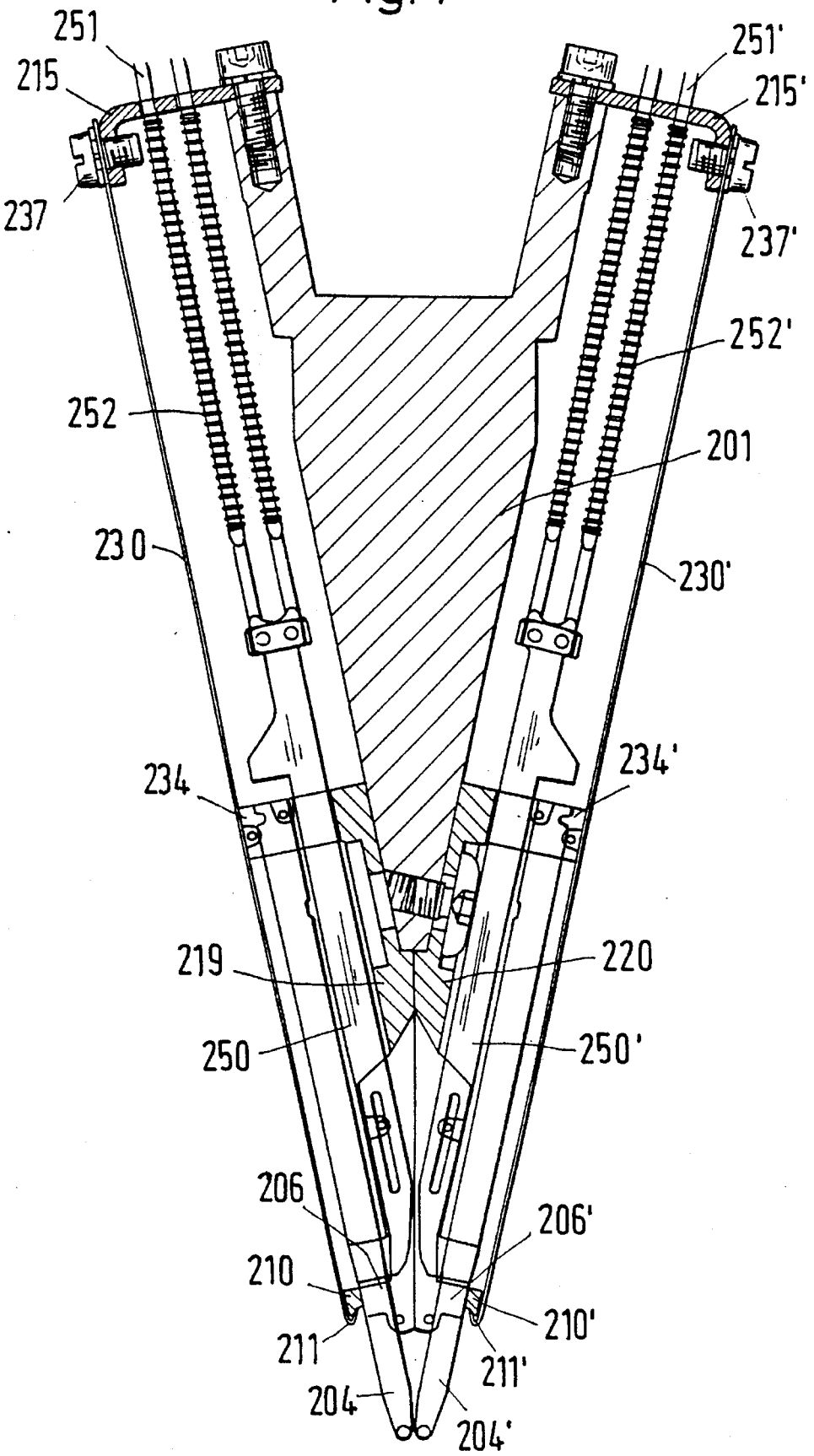
FIG. 7 shows a cross section through a further embodiment of a Jacquard bar, also in accordance with the principles of the present invention.

In FIG. 7 reference numbers increased by 200 are used for the related parts. A guide bar 201 carries holding segments 219 and 220 for a first row of guides 204 and a second row of guides 204'. The guides are moved to and fro between two stops by means of forcing elements 250, 250' which can be moved up by harness cords 251, 251' and down by restoring springs 252, 252'. Cover plates 230, 230' are also provided here, which at their lower end form a redirecting edging 211, 211' and are supported behind a rib 210, 210'. The upper ends are attached to carriers 215, 215' by means of screws 237, 237'. The cover plates are supported in their centre on support elements 234, 234'.

Obviously many modifications and variations of the present invention are possible in light of the above teachings. It is therefore to be understood that within the scope of the appended claims, the invention may be practiced otherwise than as specifically described.

I claim:

1. Jacquard bar for warp knitting machines comprising:

a spaced plurality of stops;

a plurality of guides arranged in at least one row to interdigitate with and reciprocate between said stops;

a control device for selectively positioning said guides between said stops; and a thread redirecting edging for covering interspaces between the stops and maintaining a positionally fixed relationship with the stops by connection with the stops, the redirecting edging being formed as a longitudinal rib connecting across the stops.

2. Jacquard bar according to claim 1, comprising:

a holding segment attached to the bar for supporting a group of said stops, said longitudinal rib comprising:

a plurality of longitudinal ribs spanning said stops, adjacent ones of said ribs overlapping each other to form a flush joint having a thread redirecting segment extending along a predetermined direction having a longitudinal component.

3. Jacquard bar according to claim 2, wherein a section of the flush joint distal from the thread redirecting segment has a width in a longitudinal direction sized to allow thread insertion.

4. Jacquard bar according to claim 1, comprising:

a plurality of holding segments attached to the bar for supporting a group of said stops, said longitudinal rib comprising:

a plurality of longitudinal ribs mounted on corresponding ones of said holding segments for spanning said stops, adjacent ones of said ribs overlapping each other to form a flush joint having a thread redirecting segment extending along a predetermined direction having a longitudinal component.

5. Jacquard bar according to claim 4, wherein a section of the flush joint distal from the thread redirecting segment has a width in a longitudinal direction sized to allow thread insertion.

6. Jacquard bar for warp knitting machines comprising:

a spaced plurality of stops;

a plurality of guides arranged in at least one row to interdigitate with and reciprocate between said stops;

a control device for selectively positioning said guides between said stops; and a thread redirecting edging for covering interspaces between the stops and maintaining a positionally fixed relationship with the stops by connection with the stops, said edging comprising a cover plate having a longitudinal edge for redirecting thread.

7. Jacquard bar according to claim 6, wherein the stops include a plurality of extensions and wherein the redirecting edging comprises:

a cover plate having a curled longitudinal edge for redirecting thread and being mounted with a section of the curled longitudinal edge on said extensions, said curled longitudinal edge having attaching means for positively and detachably connecting said cover plate to said bar.

8. Jacquard bar according to claim 7, wherein the extensions have recesses sized to receive said section of said curled longitudinal edge of the cover plate, said curled longitudinal edge being curled by more than 90°.

9. Jacquard bar according to claim 7, comprising:

at least one longitudinal rib spanning the extensions.

10. Jacquard bar according to claim 9, wherein at least the redirecting edging has an anti-wear coating.

11. Jacquard bar according to claim 7 wherein said cover plate has an opposite longitudinal edge opposite said curled longitudinal edge, said bar comprising:

a support element for supporting the cover plate at a point between said curled longitudinal edge and said opposite longitudinal edge.

12. Jacquard bar according to claim 11, wherein the opposite longitudinal edge also has a bight forming an opposite edging for redirecting thread.

13. Jacquard bar according to claim 11, wherein said bar has a carrier and wherein the opposite longitudinal edge of the cover plate comprises:

a support extremity for engaging said carrier on said bar;

two pleated, contractable, sheet metal sections; and at least one threaded element mounted at said sheet metal sections for urging together the support extremity and the redirecting edging.

14. Jacquard bar according to claim 7, wherein the cover plate has a thickness of 0.2 to 1.0 mm.

15. Jacquard bar according to claim 6, wherein said cover plate has an opposing pair of longitudinal edges for redirecting thread at upstream and downstream locations.

16. Jacquard bar according to claim 15, wherein the cover plate comprises:

a plurality of flush segments with adjacent ones mounted to overlap in the vicinity of at least one of said pair of longitudinal edges to form a flush joint having a thread redirecting segment extending along a predetermined direction having a longitudinal component.

17. Jacquard bar according to claim 16, wherein the predetermined direction of the thread redirecting segment is longitudinal.

18. Jacquard bar according to claim 16 wherein the predetermined direction of the thread redirecting segment forms an angle of less than 45° from longitudinal.

19. Jacquard bar according to claim 16, wherein a section of the flush joint distal from the thread redirecting segments has a width in a longitudinal direction sized to allow thread insertion.

20. Jacquard bar according to claim 6, wherein the cover plate comprises:

a plurality of flush segments with adjacent ones mounted to overlap to form a flush joint having a thread redirecting segment extending along a predetermined direction having a longitudinal component.

21. Jacquard bar according to claim 20 wherein the predetermined direction of the thread redirecting segment is longitudinal.

22. Jacquard bar according to claim 20, wherein the predetermined direction of the thread redirecting segment forms an angle of less than 45° from longitudinal.

23. Jacquard bar according to claim 20 wherein a section of the flush joint distal from the thread redirecting segment has a width in a longitudinal direction sized to allow thread insertion.

24. Jacquard bar for warp knitting machines comprising:

a spaced plurality of stops;

a plurality of guides arranged in at least one row to interdigitate with and reciprocate between said stops;

a control device for selectively positioning said guides between said stops; and a thread redirecting edging for covering interspaces between the stops and maintaining a positionally fixed relationship with the stops by connection with the stops, at least the redirecting edging having an anti-wear coating.

* * * * *